United States Patent [19]

Sindlinger

[11] Patent Number: 4,813,893

[45] Date of Patent: Mar. 21, 1989

[54] ELECTRICAL TERMINAL AND METHOD OF ASSEMBLY

[75] Inventor: Thomas H. Sindlinger, York, Pa.

[73] Assignee: AMP Incorporated, Harrisburg, Pa.

[21] Appl. No.: 195,994

[22] Filed: May 17, 1988

[51] Int. Cl.[4] ..... H01R 4/18

[52] U.S. Cl. ..... 439/730; 439/877; 439/879; 29/882

[58] Field of Search ..... 439/877, 879, 882, 868, 439/885, 883, 889, 891, 932, 730; 174/74 R, 75 R, 84 C; 29/874, 876, 882

[56] References Cited

U.S. PATENT DOCUMENTS 2,715,716 8/1955 Woolley, Jr. ..... 439/730
2,855,581 10/1958 Freedom ..... 29/874 X
2,964,171 12/1960 Chadwick ..... 439/877 X
3,774,141 10/1973 Condon ..... 439/730

OTHER PUBLICATIONS

AMP Inc., Catalog No. 570, Rev. 5-70, "Ampli-Bond".

*Primary Examiner*—Eugene F. Desmond
*Assistant Examiner*—Stephen A. Zagrobelny
*Attorney, Agent, or Firm*—Allan B. Osborne

[57] ABSTRACT

An electrical terminal having an insulating sleeve thereon. More particularly, the terminal includes a copper ferrule located on the wire barrel of the terminal and an insulating sleeve over the ferrule. The sleeve is secured to the terminal by an end thereof being clinched between a bell-mouth end of the ferrule and the wire barrel.

2 Claims, 2 Drawing Sheets

ELECTRICAL TERMINAL AND METHOD OF ASSEMBLY

FIELD OF THE INVENTION

The invention relates to electrical terminals of the type which are crimped onto electrical wires and to a method of assembly.

BACKGROUND OF THE INVENTION

Prior art terminals such as shown in FIG. 1 are assembled in part by chemically bonding the insulating sleeve to a copper ferrule. The use of chemicals however, are objectionable from safety and environmental view points. It is, therefore, desirable to secure the insulating sleeve to the ferrule mechanically.

SUMMARY OF THE INVENTION

According to the invention, an electrical terminal is provided wherein an insulating sleeve is secured thereto by an end thereof being folded into a space defined by a bell-mouth end of a copper ferrule over which the sleeve is positioned and a wire barrel of the terminal on which the ferrule is positioned and thereafter radically clinching the bell mouth end against the wire barrel.

DESCRIPTION OF THE PRIOR ART

Figure 1:
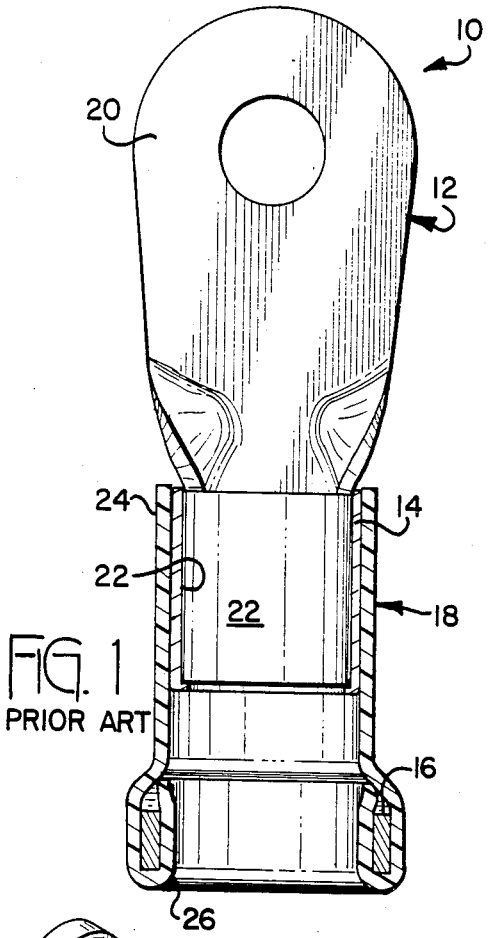
FIG. 1 PRIOR ART
FIG. 1 is a sectional view of a prior art terminal.

As shown in FIG. 1, prior art terminal 10 includes terminal body 12, cylindrical copper ferrule 14, insulation support ring 16 and insulation sleeve 18. Body 12 includes tongue 20 at one end and wire barrel 22 at the other end. In making terminal 10, ferrule 14 is bonded to the inside surface and at end 24 of sleeve 18. Opposite end 26 of sleeve 18 is folded in around support ring 16. Wire barrel 22 is then inserted into ferrule 14 and clinched to complete the assembly. Terminal body 12 is made from copper and tin-plated as is ferrule 14. Ring 16 is made from steel and sleeve 18 is made from polyvinyl chloride.

DESCRIPTION OF THE PRESENT INVENTION

Figure 2:
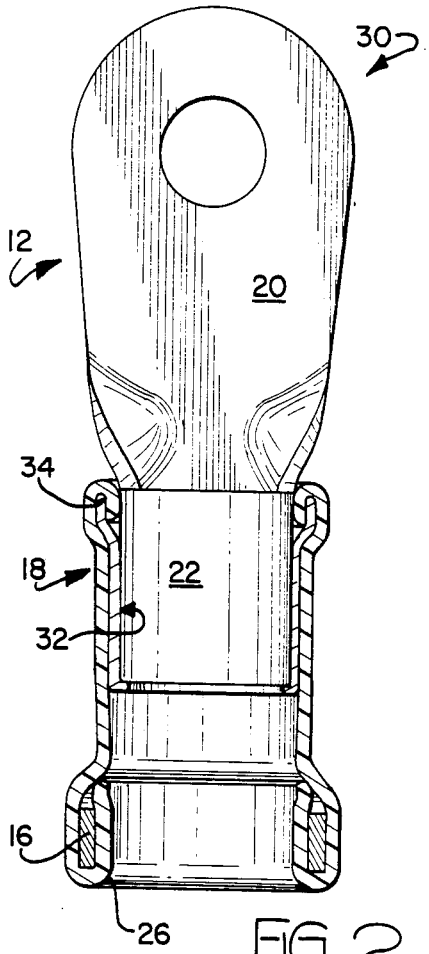
FIG. 2 is a sectional view of a terminal constructed in accordance with the preferred embodiment of the present invention.
Figure 3:
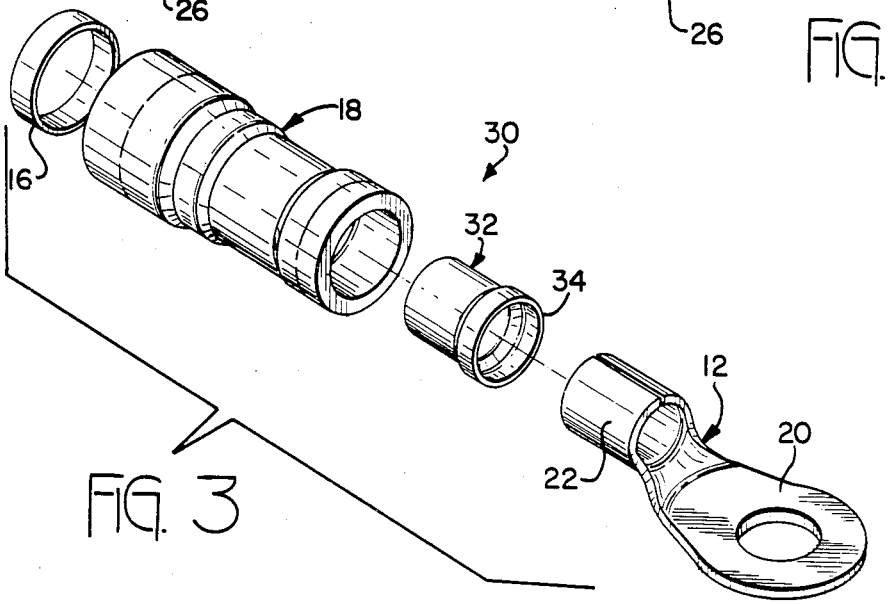
FIG. 3 is a perspective, exploded view of the terminal of FIG. 2.
Figure 4:
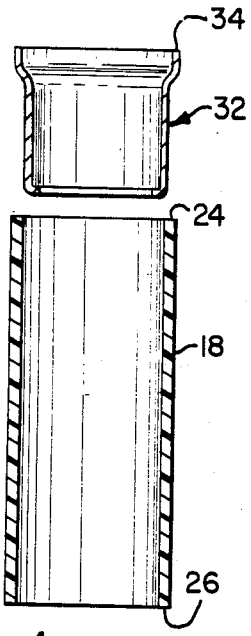
FIGS. 4–7 are sectional views showing a preferred method of making the terminals of FIG. 2.

FIG. 2 illustrates terminal 30 constructed in accordance with the present invention. Except for copper ferrule 14, terminal 30 includes components 12, 16 and 18 of terminal 10. In lieu of ferrule 14, terminal 30 utilizes copper ferrule 32 which, instead of being completely cylindrical, includes bell-mouth end 34. FIG. 3 shows the several components of terminal 30 in exploded fashion.

DESCRIPTION OF THE METHOD OF ASSEMBLY

Figure 5:
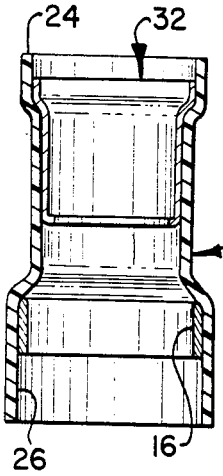
Figure 7:
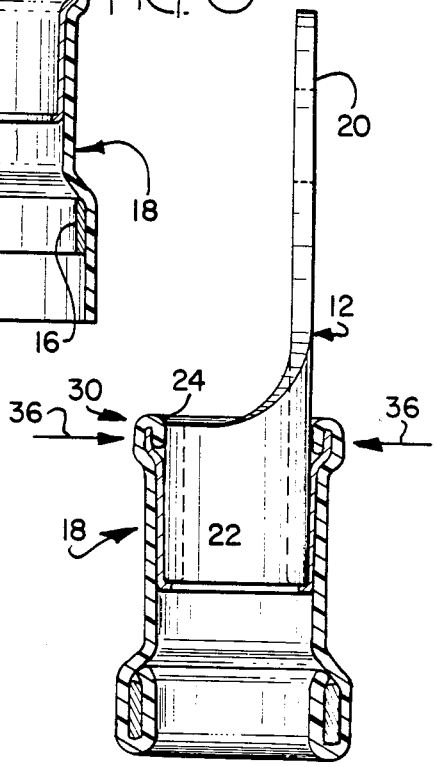
Figure 6:
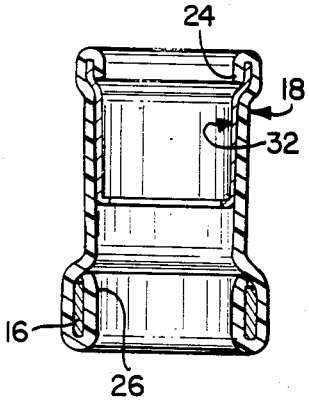

FIGS. 4 through 7 illustrate the preferred method of making terminal 30. The first step is to insert copper ferrule 32 into insulating sleeve 18 so that end 24 thereof extends beyond bell-mouth end 34. Ring 16 is then inserted into end 26 of sleeve 18. As indicated in FIG. 5, sleeve 18 stretches to accommodate ring 16 and ferrule 32. Ends 24 and 26 of sleeve 18 are next tucked in over bell-mouth end 34 and ring 16 respectively, and due to the nature of the material, remains in position. FIG. 6 shows the assembly at this stage. Finally, terminal body 12 is inserted into copper ferrule 32 from bell-mouth end 34. FIG. 7, tucked-in end 24 of sleeve 18, is positioned between ferrule 32 and body 12, and is then trapped or secured therein by radially clinching bell-mouth end 34 towards wire barrel 22 as indicated by arrows 36.

Figure 8:
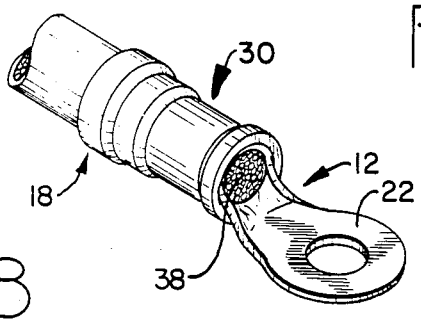
FIG. 8 is a perspective view of a terminal of FIG. 2 crimped onto an electrical wire.

FIG. 8 is a view showing a terminal 30 crimped onto wire 38.

Testing of terminals 30 have shown that all performance requirements during heating and freezing cycles are met and that insulating sleeve 18 remained secured.

As can be discerned, a terminal has been disclosed wherein the insulating sleeve is secured thereto by tucking or folding-in and clinching one end between a copper ferrule and terminal body.

I claim:

1. An electrical terminal comprising:

a conductive terminal body having a wire barrel at one end and fastening means at another end for fastening the terminal to an electrical component;

a copper ferrule for placing around at least a portion of said wire barrel, said ferrule having a bell-mouth at one end; and an insulating sleeve for placing around said copper ferrule with one end thereof being folded into a space defined by and located between said bell mouth end of said ferrule and said wire barrel and for being trapped therein.

2. A method of assembling an electrical terminal of the type having a terminal body with a wire barrel, a copper ferrule and an insulating sleeve, said method comprising the steps of:

providing a copper ferrule with a bell mouth end;

inserting said ferrule into an insulating sleeve so that one end of said sleeve extends beyond said bell-mouth end;

folding said one end of said sleeve into said bell-mouth end;

inserting a wire barrel of a terminal body into said copper ferrule; and clinching said bell-mouth end radially inwardly to secure said folded in end of said insulating sleeve between said bell-mouth end and said wire barrel.

* * * * *